US009136080B2

(12) United States Patent
Sumino et al.

(10) Patent No.: US 9,136,080 B2
(45) Date of Patent: Sep. 15, 2015

(54) ELECTROMAGNET DEVICE AND ELECTROMAGNETIC RELAY USING THE SAME

(71) Applicant: Omron Corporation, Kyoto-shi (JP)

(72) Inventors: Toshifumi Sumino, Katano (JP); Masaaki Yamamoto, Ibaraki (JP); Ichinori Sakai, Higashiomi (JP); Tatsuro Kato, Kusatsu (JP); Kazuya Murakami, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/955,283

(22) Filed: Jul. 31, 2013

(65) Prior Publication Data

US 2014/0055221 A1 Feb. 27, 2014

(30) Foreign Application Priority Data

Aug. 24, 2012 (JP) ..... 2012-185882

(51) Int. Cl.

| | |
|---|---|
| ***H01H 9/00*** | (2006.01) |
| ***H01H 50/20*** | (2006.01) |
| ***H01H 50/26*** | (2006.01) |
| ***H01H 50/36*** | (2006.01) |

(Continued)

(52) U.S. Cl.

CPC ..... *H01H 50/20* (2013.01); *H01H 50/26* (2013.01); *H01H 50/36* (2013.01); *H01H 51/2236* (2013.01); *H01H 50/42* (2013.01); *H01H 50/642* (2013.01)

(58) Field of Classification Search

CPC ..... H01H 50/26; H01H 50/56; H01H 50/64; H01F 7/122; H01F 7/1615; H01F 7/1646; H01F 7/14; H01F 7/08; H01F 7/00; H01F 2007/1692; H01F 3/00

USPC ..... 335/179

See application file for complete search history.

(56) References Cited

U.S. PATENT DOCUMENTS 2,735,968 A * 2/1956 Bogue et al. ..... 335/275
4,302,742 A * 11/1981 Schedele ..... 335/202

(Continued)

FOREIGN PATENT DOCUMENTS

| | | |
|---|---|---|
| EP | 1895560 A2 | 3/2008 |
| GB | 2137813 | 10/1984 |
| JP | 2004164948 A | 6/2004 |

OTHER PUBLICATIONS

European Search Report for corresponding application EP13178838 dated Dec. 11, 2013.

*Primary Examiner* — Shawki S Ismail
*Assistant Examiner* — Lisa Homza
(74) *Attorney, Agent, or Firm* — Klarquist Sparkman, LLP

(57) ABSTRACT

The present invention provides an electromagnet device including: an electromagnet block having a spool around which a coil is wound and an iron core inserted in a central hole of the spool; a yoke connected to an end portion of the iron core via a permanent magnet; a movable iron piece pivotably supported on a pivoting shaft center located at an end face edge portion of the yoke, the movable iron piece is adapted to pivot on a basis of magnetization and demagnetization of the electromagnet block, and a protrusion having a linear edge portion which extends in parallel to the pivoting shaft center and the protrusion protrudes from at least either the movable iron piece or the iron core, the protrusion protrudes in a facing direction in which the movable iron piece and the iron core face each other.

4 Claims, 18 Drawing Sheets

(51) Int. Cl.

| | |
|---|---|
| ***H01H 51/22*** | (2006.01) |
| *H01H 50/42* | (2006.01) |
| *H01H 50/64* | (2006.01) |

(56) References Cited

U.S. PATENT DOCUMENTS

| | | | | | |
|---|---|---|---|---|---|
| 4,618,842 | A | * | 10/1986 | Nestlen et al. | 335/128 |
| 4,758,809 | A | * | 7/1988 | Bell | 335/128 |
| 4,761,627 | A | * | 8/1988 | Bell | 335/128 |
| 4,825,179 | A | * | 4/1989 | Nagamoto et al. | 335/80 |
| 4,958,137 | A | * | 9/1990 | Schroeder | 335/128 |
| 5,160,910 | A | * | 11/1992 | Tsuji | 335/129 |
| 5,202,663 | A | * | 4/1993 | Tomono et al. | 335/86 |
| 5,204,647 | A | * | 4/1993 | Mitsuki et al. | 335/80 |
| 5,289,144 | A | * | 2/1994 | Liao | 335/78 |
| 5,321,377 | A | * | 6/1994 | Aharonian | 335/78 |
| 5,392,015 | A | * | 2/1995 | Matsuoka et al. | 335/78 |
| 5,572,176 | A | * | 11/1996 | Heinzl et al. | 335/129 |
| 5,680,082 | A | * | 10/1997 | Stocklin | 335/128 |
| 5,757,255 | A | * | 5/1998 | Noda et al. | 335/78 |
| 5,805,040 | A | * | 9/1998 | Corcoran | 335/202 |
| 5,864,270 | A | * | 1/1999 | Hoffman | 335/78 |
| 5,907,268 | A | * | 5/1999 | Mader | 335/202 |
| 5,969,586 | A | * | 10/1999 | Noda et al. | 335/83 |
| 6,034,582 | A | * | 3/2000 | Fausch | 335/78 |
| 6,323,747 | B1 | * | 11/2001 | Mader et al. | 335/80 |
| 6,486,760 | B2 | * | 11/2002 | Miyazaki et al. | 335/78 |
| 6,606,018 | B2 | * | 8/2003 | Takano et al. | 335/78 |
| 6,731,190 | B2 | * | 5/2004 | Yamashita et al. | 335/78 |
| 7,205,870 | B2 | * | 4/2007 | Sanada et al. | 335/78 |
| 7,477,119 | B2 | * | 1/2009 | Wu | 335/83 |
| 7,750,769 | B2 | * | 7/2010 | Minowa et al. | 335/78 |
| 7,859,371 | B2 | * | 12/2010 | Takano | 335/78 |
| 7,994,884 | B2 | * | 8/2011 | Kuo | 335/78 |
| 8,111,117 | B2 | * | 2/2012 | Minowa et al. | 335/78 |
| 2003/0231090 | A1 | * | 12/2003 | Copper et al. | 335/128 |

* cited by examiner

FIG. 13B

| POSITION L3 FROM FULCRUM | | RETENTION FORCE (N) | COMPARISON WITH OPTIMAL POSITION |
|---|---|---|---|
| (mm) | (%) | | |
| 7.75 | 25% | 2.26 | RETENTION FORCE 7.6% DOWN |
| 8.25 | 42% | 2.36 | RETENTION FORCE 3.5% DOWN |
| 8.75 (OPTIMAL) | 58% | 2.44 | — |
| 9.25 | 75% | 2.41 | RETENTION FORCE 1.1% DOWN |
| 9.75 | 92% | 2.25 | RETENTION FORCE 7.6% DOWN |

FIG. 14B

| POSITION L3 FROM FULCRUM | | RETENTION FORCE (N) | COMPARISON WITH OPTIMAL POSITION |
|---|---|---|---|
| (mm) | (%) | | |
| 7.75 | 25% | 2.35 | RETENTION FORCE 7.6% DOWN |
| 8.25 | 42% | 2.41 | RETENTION FORCE 3.5% DOWN |
| 8.75 (OPTIMAL) | 58% | 2.53 | — |
| 9.25 | 75% | 2.19 | RETENTION FORCE 1.1% DOWN |
| 9.75 | 92% | 1.92 | RETENTION FORCE 7.6% DOWN |

ELECTROMAGNET DEVICE AND ELECTROMAGNETIC RELAY USING THE SAME

CROSS REFERENCE TO RELATED APPLICATION

This application claims benefit of priority to Japanese Patent Application No. 2012-185882, filed on Aug. 24, 2012 of which the full contents are herein incorporated by reference.

BACKGROUND OF THE INVENTION

The present invention relates to an electromagnet device.

Japanese Patent Publication No. 2004-164948 (Also published as U.S. Pat. No. 7,205,870) discloses one of the conventional electromagnetic device to be used in an electromagnetic relay. The electromagnet device disclosed in said document includes an attracted portion of a movable iron piece and an attracting surface of an iron core wherein both the movable iron piece and the attracting surface are flat and smooth to achieve attraction.

However, since the attracted portion and the attracting surface are flat and smooth in the electromagnet device, this lead to various problems such as magnetic flux flowing between the movable iron piece and the iron core spreads which reduces magnetism and thereby weaken a retention force between the movable iron piece and the iron core.

SUMMARY OF THE INVENTION

Accordingly, the present invention provides an electromagnetic device which overcomes the above-mentioned problems and limitations of conventional art. Further, the present invention provides an electromagnet device which can maintain a strong retention force between a movable iron piece and an iron core and an electromagnetic relay using the electromagnet device.

In accordance with one aspect of the present invention, there is provided an electromagnet device including an electromagnet block comprising a spool around which a coil is wound and an iron core inserted in a central hole of the spool, a yoke connected to an end portion of the iron core via a permanent magnet, and a movable iron piece pivotably supported on a pivoting shaft center, located at an end face edge portion of the yoke, wherein the movable iron piece is adapted to pivot on a basis of magnetization and demagnetization of the electromagnet block. Further, a protrusion comprising a linear edge portion which extends in parallel to the pivoting shaft center and the protrusion protrudes from at least either the movable iron piece or the iron core, wherein the protrusion protrudes in a facing direction in which the movable iron piece and the iron core face each other, and the movable iron piece is adapted to be in line contact with the iron core via the outer edge portion of the protrusion on magnetization of the electromagnet block, wherein the outer edge portion is located in an outside position as compared with a central axis of the iron core when the electromagnet block is magnetized.

According to another aspect of the present invention, a curving surface which projects toward the facing direction is provided and is formed in a surface of the protrusion.

According to still another aspect of the present invention, the protrusion may be provided in the movable iron piece, and the outer edge portion is adapted to be in contact with a magnetic pole surface of the iron core.

In accordance with one of the preferred embodiment of the present invention, the protrusion may be provided in the iron core, and the outer edge portion is adapted to be in contact with the horizontal portion of the movable iron piece.

According to yet another aspect of the present invention, there is provided an electromagnetic relay which may use the electromagnet device according to one of the above aspects.

BRIEF DESCRIPTION OF THE DRAWINGS

The invention will become more readily appreciated and understood from the following detailed description of preferred embodiments of the invention when taken in conjunction with the accompanying drawings, in which:

FIG. 13B is a table showing a calculation result where a retention force changes with a position of a contact protrusion within the horizontal portion;

FIG. 14B is a table showing a calculation result in which a retention force changes with a position of the contact protrusion within the horizontal portion.

DETAILED DESCRIPTION

Figure 1A:
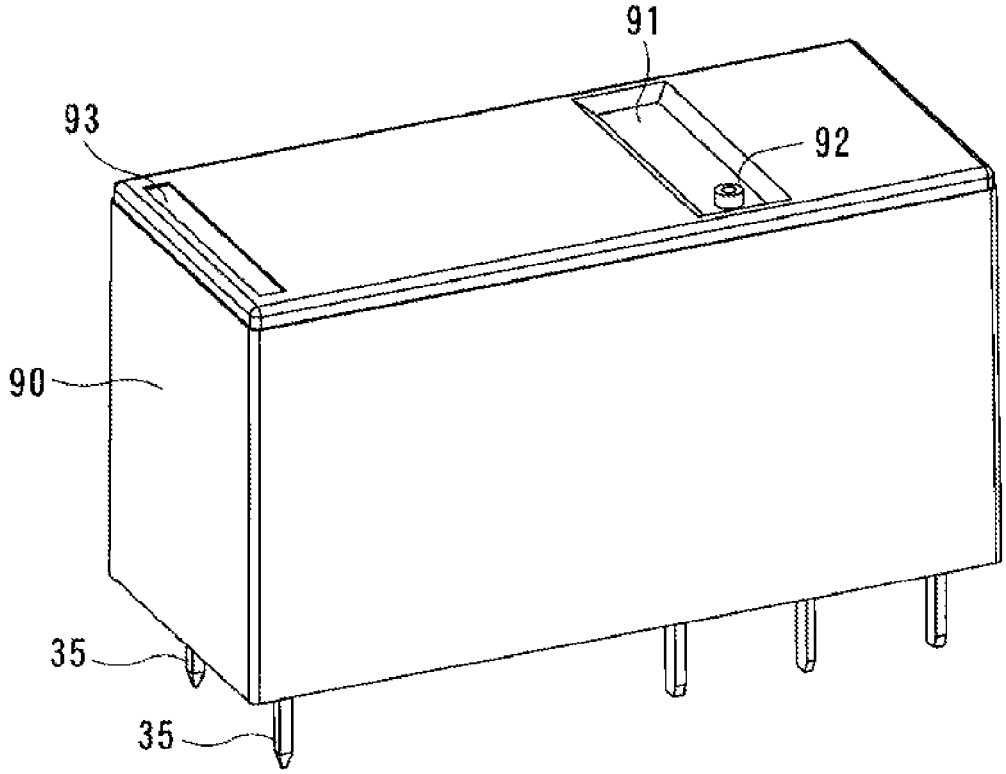
FIGS. 1A and 1B are perspective views of an electromagnetic relay incorporating an electromagnet device according to a first embodiment of the invention.
Figure 1B:
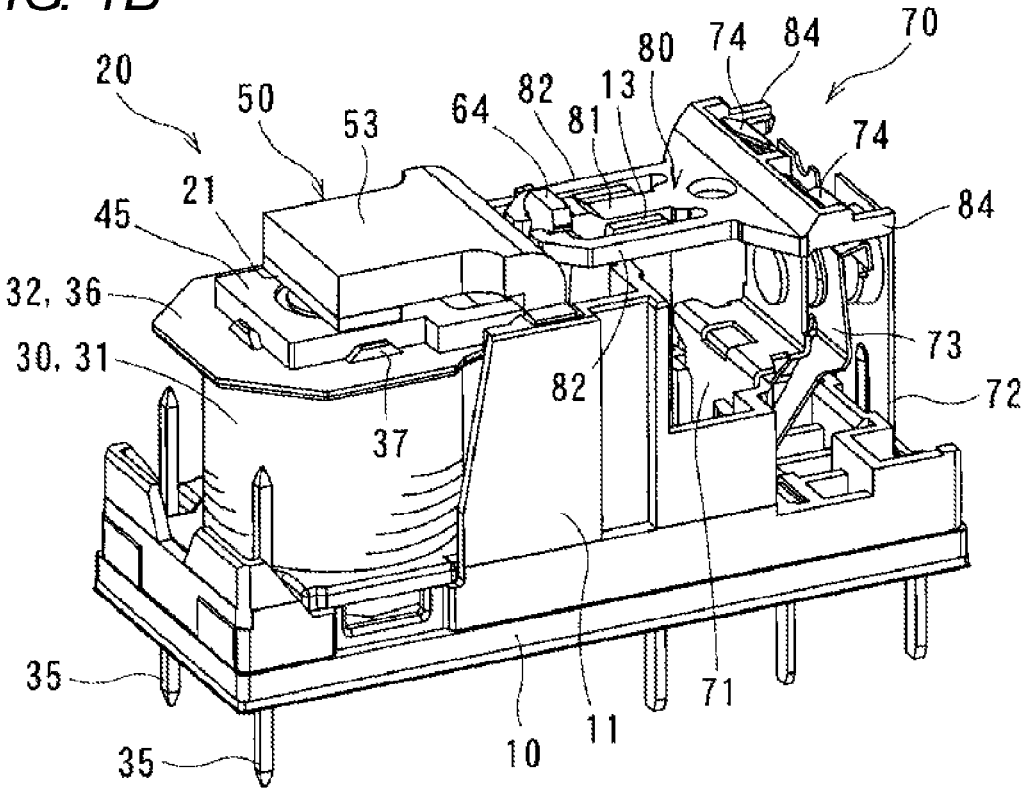

The present invention is described hereinafter by various embodiments with reference to the accompanying drawings, wherein reference numerals used in the accompanying drawings correspond to the like elements throughout the description. Further, while discussing various embodiments, cross reference will made between the figures. In order to achieve full description and explanation, specific details have been mentioned to provide thorough and comprehensive understanding of various embodiments of the present invention. However, said embodiments may be utilized without such specific details and in various other ways broadly covered herein.

An electromagnet device according to one of the embodiment of the present invention is described with reference to FIGS. 1A to 12B. The electromagnet device is incorporated into a latching type electromagnetic relay as illustrated in FIGS. 1A to 8B. In this case, the electromagnet device includes a base 10, an electromagnet device 20, a contact mechanism 70, a card 80 and a box-shaped cover 90. Further, the card 80 is connected to the electromagnet device 20 and drives the contact mechanism 70.

Figure 2:
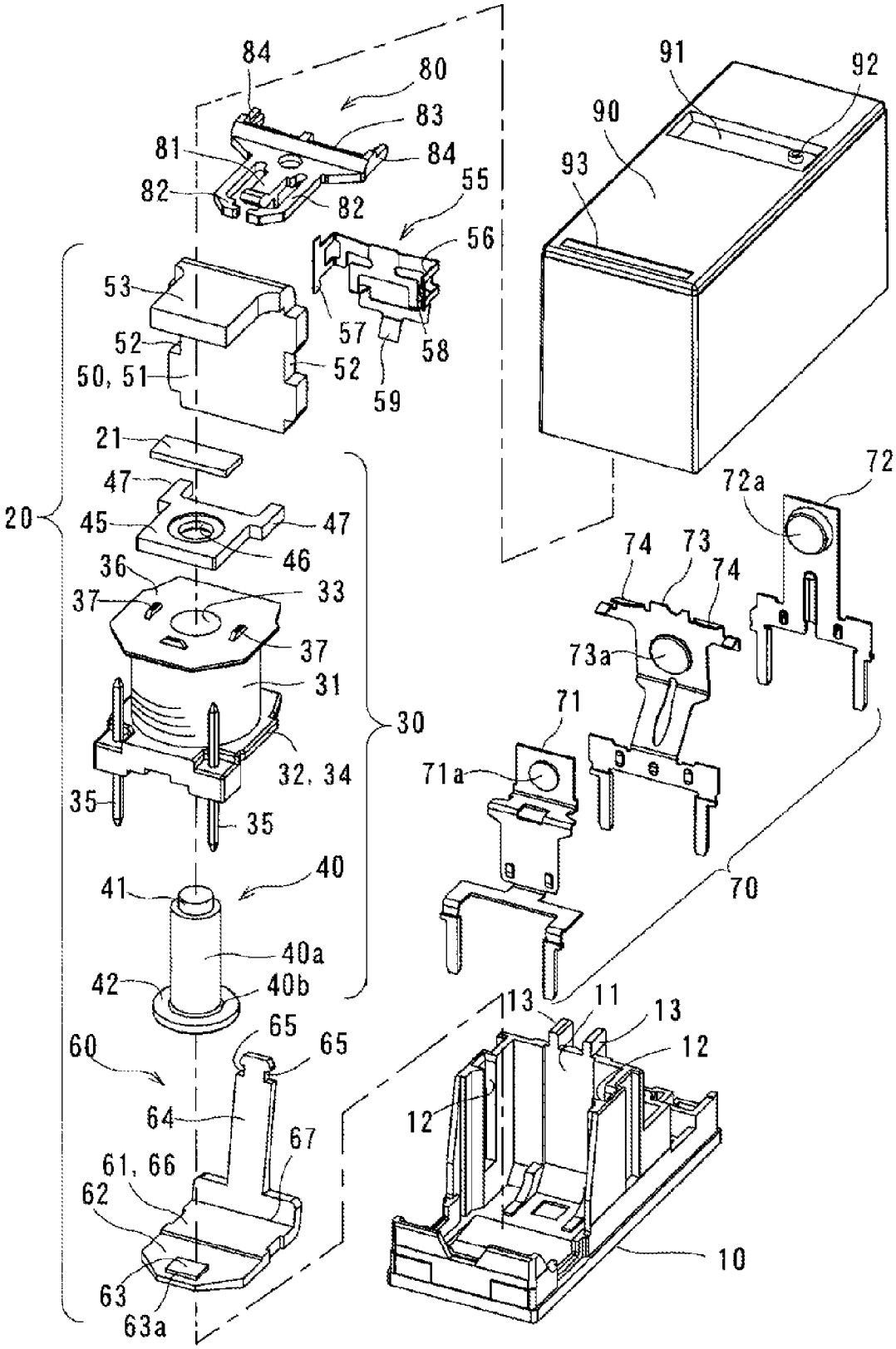
FIG. 2 is an exploded perspective view of the electromagnetic relay, illustrated in FIGS. 1A and 1B, which is obliquely viewed from the top.
Figure 3:
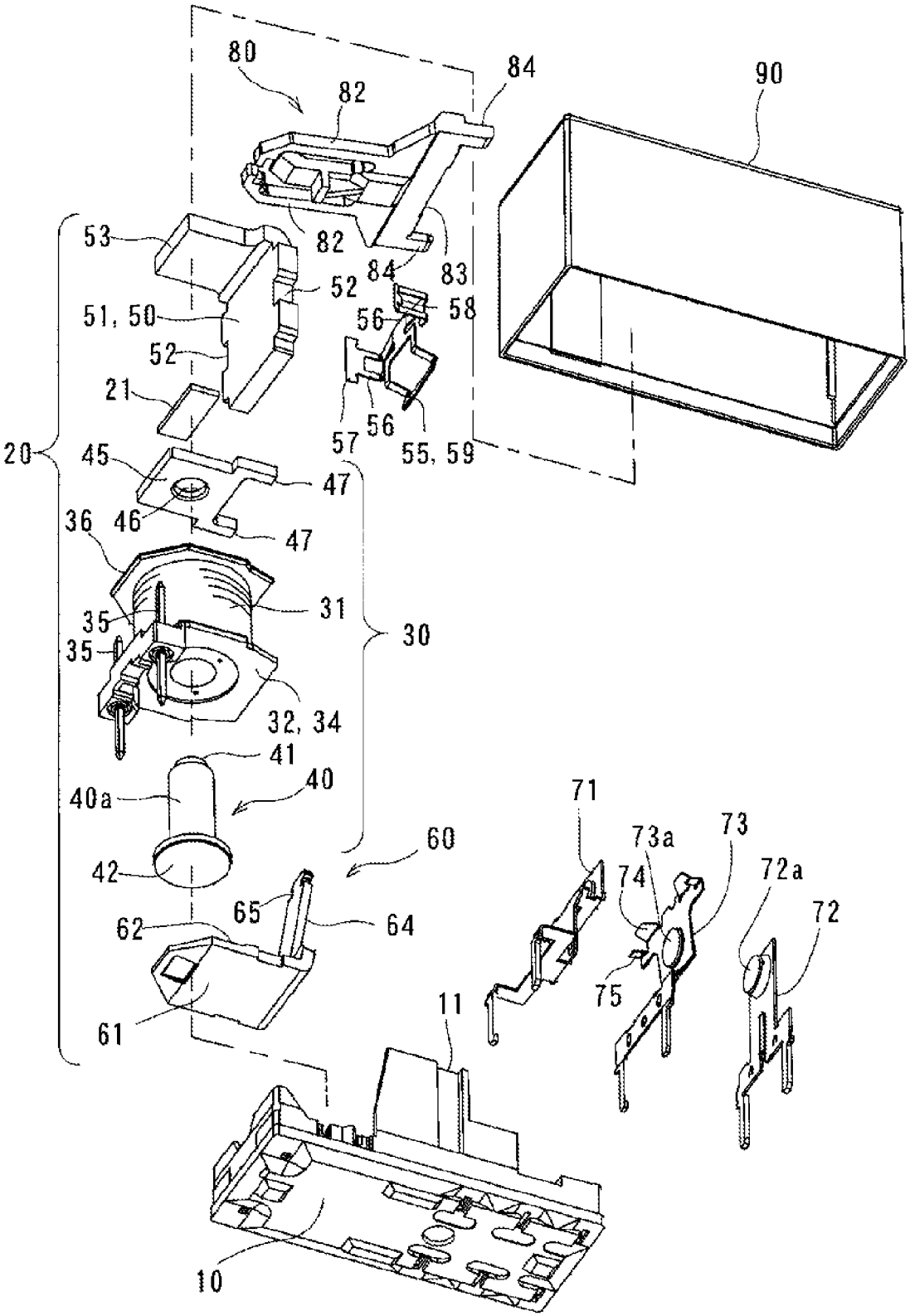
FIG. 3 is an exploded perspective view of the electromagnetic relay, illustrated in FIGS. 1A and 1B, which is obliquely viewed from the bottom.

As illustrated in FIGS. 2 and 3, the base 10 has an approximately C-shaped insulation wall 11 which protrudes upward from an upper surface of the base 10. in a center portion on the upper surface. The electromagnet device 20 described below is arranged in one side portion on the upper surface, and the contact mechanism 70 is arranged in the opposite side portion on the upper surface. The insulation wall 11 is provided with fitting grooves 12 which are formed in both inside surfaces, respectively which face each other. In the fitting grooves 12, both side edge portions of a yoke 50 are press-fitted. In addition, a center portion of an upper end of the insulation wall 11 is provided with a pair of guide ribs 13 that are in parallel with each other and protrude from an upper surface thereof.

Figure 4A:
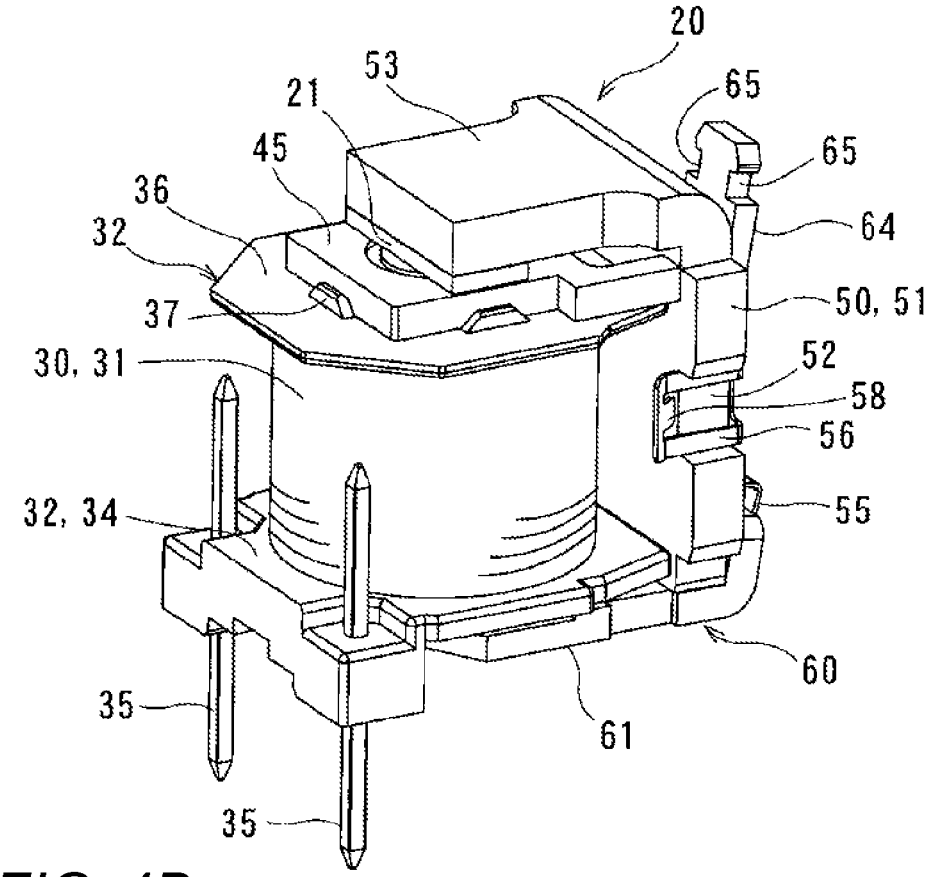
FIGS. 4A and 4B are perspective views showing the electromagnet device according to the first embodiment of the invention.
Figure 4B:
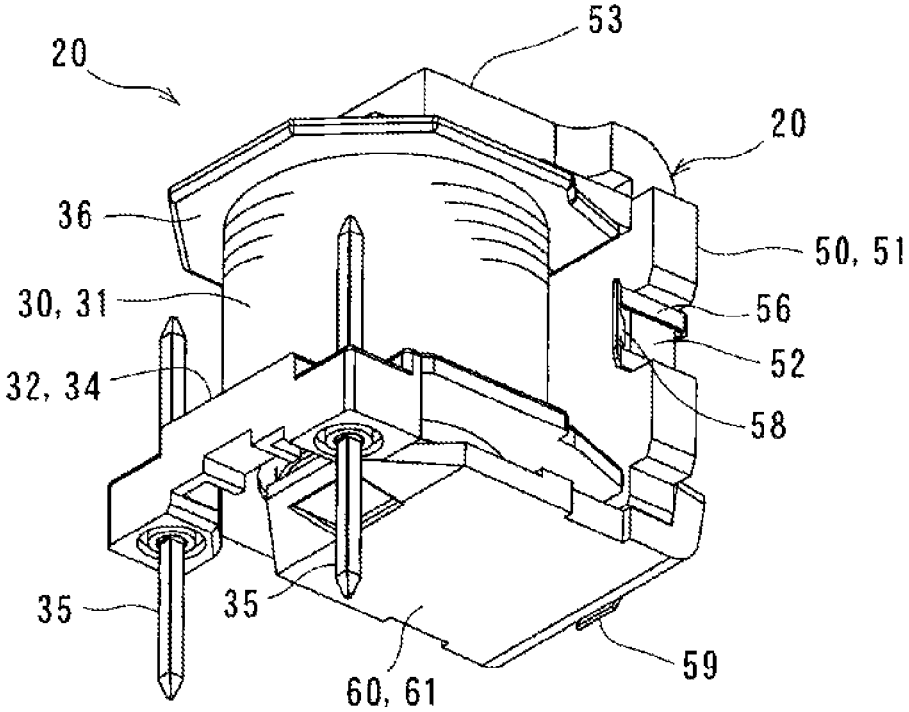
Figure 5:
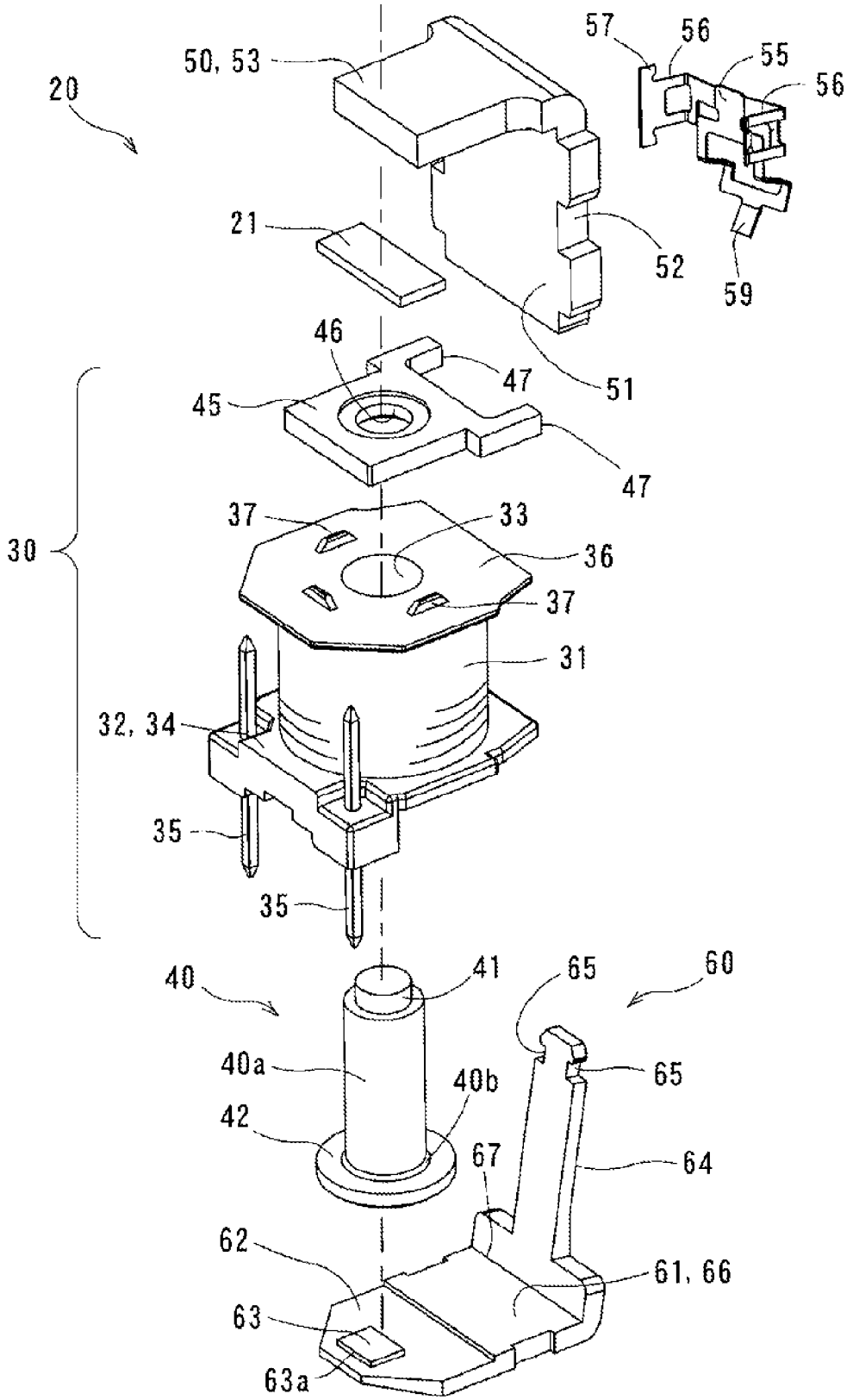
FIG. 5 is an exploded perspective view of the electromagnet device, illustrated in FIG. 4A, which is obliquely viewed from the top.

As illustrated in FIGS. 4A, 4B, and 5, the electromagnet device 20 includes an electromagnet block 30 in which an iron core 40 having an almost T-shaped cross section passes through a central hole 33 of a spool 32 around which a coil 31 is wound, and an auxiliary yoke 45 is fixed by caulking to an upper end portion 41 of the iron core 40 which protrudes from the central hole 33. The electromagnet device 20 further includes the yoke 50 having a substantially L-shaped cross section which is assembled so that a plate-like permanent magnet 21 is interposed between the yoke 50 and an upper end face of the iron core 40, a support spring 55 attached to a rear surface of the yoke 50, and a movable iron piece 60 which is pivotably supported on a lower end face edge portion of the yoke 50 via the support spring. The lower end face edge portion of the yoke 50 serves as a fulcrum for pivoting the movable iron piece 60.

In the spool 32, extended wires of the coil 31 are connected and soldered to coil terminals 35 which are press-fitted in corner portions of a guard portion 34. In the spool 32, an alignment protrusion 37 for aligning a position of the auxiliary yoke 45 is formed to protrude from an upper surface of an upper guard portion 36.

The iron core 40 includes a cylindrical iron core body 40*a*, a cylindrical upper end portion 41 which is higher by one step than an upper end of the iron core body 40*a* and has a smaller diameter than the iron core body 40*a*, and a disk-like magnetic pole portion 42 which is formed in a lower end of the iron core body 40*a* and has a larger diameter than the iron core body 40*a*. A curving portion 40*b* is formed in the boundary of the iron core body 40*a* and the magnetic pole portion 42, along a circumferential direction. For this reason, magnetic flux which flows through the iron core 40 can be more smoothly passed from the iron core body 40*a* to the magnetic pole portion 42 via the curving portion 40*b* as compared with a case where the iron core body 40*a* and the magnetic pole portion 42 perpendicularly intersect each other.

The auxiliary yoke 45 has a caulking hole 46 in the center. The auxiliary yoke 45 extends in parallel from adjacent corner portions to form connecting narrow-width portions 47 with a small cross-sectional area. These narrow width portions are magnetic resistance portions.

The plate-like permanent magnet 21 has a width dimension substantially the same as a width dimension of the auxiliary yoke 45.

The yoke 50 has a substantially L-shaped cross section and includes a vertical portion 51 provided with notch portions 52 at both sides thereof, respectively. The notch portions 52 function to elastically engage with the support spring 55 as described below. The yoke 50 further includes a horizontal portion 53 which laterally extends from an upper end of the vertical portion 51.

Figure 6:
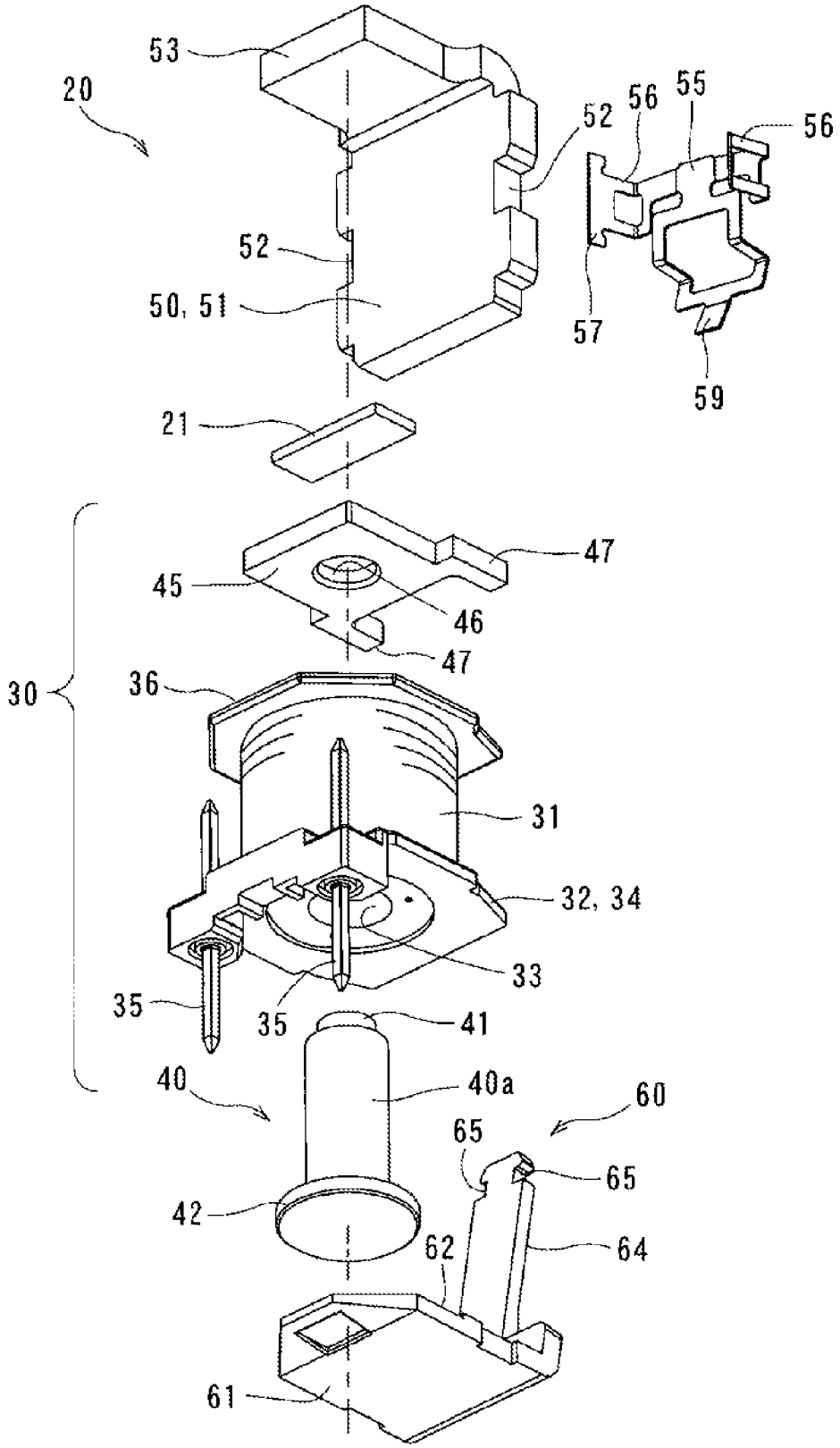
FIG. 6 is an exploded perspective view of the electromagnet device, illustrated in FIG. 4B, which is obliquely viewed from the bottom.
Figure 7A:
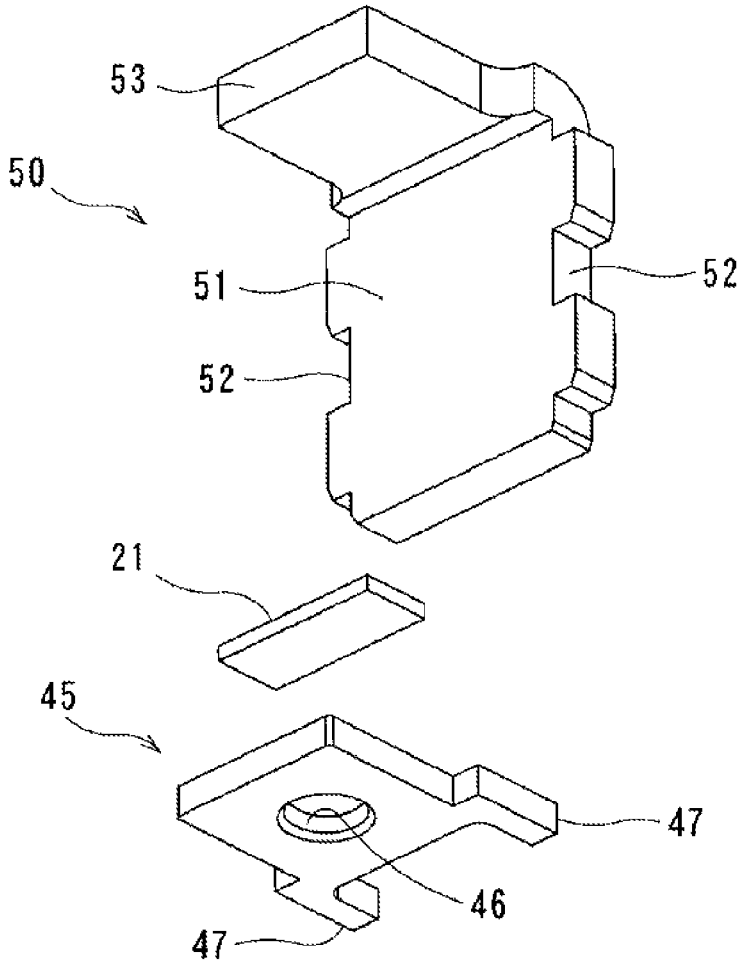
FIG. 7A is an exploded perspective view of a yoke, an auxiliary yoke, and a plate-like permanent magnet illustrated in FIG. 6.
Figure 7B:
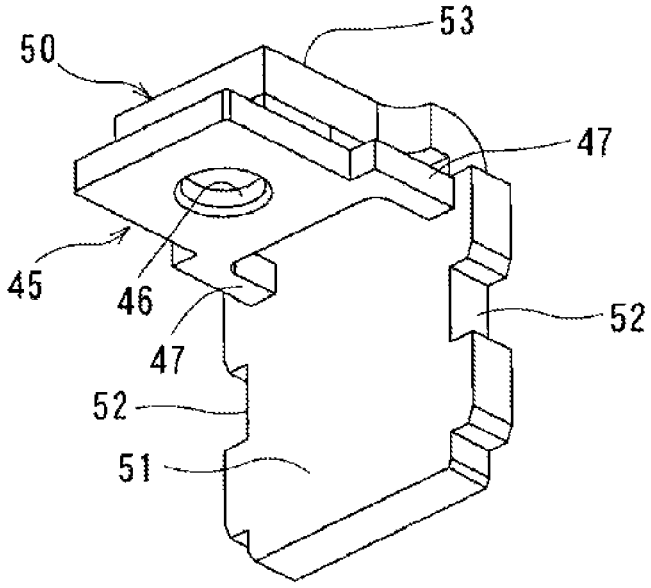
FIG. 7B is a perspective view showing a state in which the yoke, the auxiliary yoke, and the plate-like permanent magnet are assembled.

As illustrated in FIGS. 5 and 6, in the support spring 55, a pair of elastic arm portions 56 extend in parallel with each other from both side edges respectively and an elastic support portion 59 extends from a lower edge portion. While an engaging pawl 57 is formed to protrude from a leading end of either of the elastic arm portions 56, a latching pawl 58 (as shown in FIGS. 4A and 4B) is formed to stand up from a leading end of the other elastic arm portion 56.

The movable iron piece 60 includes an attracted surface 66 of an approximately rectangular shape formed in a rear half portion in an upper surface of the horizontal portion 61, and a step portion 62 which is lower by one step than the attracted surface 66 and which is formed in a front half portion. A contact protrusion 63 of a rectangular shape having a smaller area than the attracted surface 66 is formed in the step portion 62 through a protruding process. The contact protrusion 63 has an outer edge portion 63*a* disposed on an outside surface of the contact protrusion 63. The movable iron piece 60 has notch portions 65 for engaging the card 80, at both side edges of a leading end of the vertical portion 64. The boundary between the horizontal portion 61 and the vertical portion 64 serve as a pivoting shaft center 67 which is latched to a lower end edge portion of the yoke 50.

As illustrated in FIG. 2, the contact mechanism 70 includes first and second fixed touch pieces 71, 72 which are arranged to face each other in a predetermined distance, and a movable touch piece 73 arranged between the first and second fixed touch pieces 71,72. A movable contact 73*a* provided in the movable touch piece 73, which is alternately attached to and detached from a first fixed contact 71*a* and a second fixed contact 72*a*. The first and the second fixed contact 71*a*, 72*a* are provided in the first and the second fixed touch pieces 71, 72, respectively. Two sets of latching pawls 74, 75 for vertically latching a remaining end edge portion 83 of the card 80 described below are provided in an upper end portion of the movable touch piece 73.

As illustrated in FIGS. 2 and 3, in the card 80, a pair of elastic arm portions 82 and 82 extend from both sides of the contact protrusion 81, respectively that protrudes from one end, and a pair of latching arm portions 84 and 84 extend from both ends of the remaining end edge portion 83, respectively.

The box-shaped cover 90 has a box shape which can fit into the base 10. The box-shaped cover 90 is provided with a position-regulating projecting portion 91 that bulges downward from a ceiling surface (refer to FIGS. 8A and 8B) thereof, and a degassing hole 92 provided in the bottom of the position-regulating projecting portion 91. The position-regulating projecting portion 91 prevents the card 80 aligned under the position-regulating projecting portion 91 from lifting. The box-shaped cover 90 has a marking recess 93 in an end portion of the upper surface thereof.

Therefore, when assembling the electromagnetic relay, first, the permanent magnet 21 may be interposed between the horizontal portion 53 of the yoke 50 and the auxiliary yoke 45 of the electromagnet block 30 (refer to FIGS. 7A and 7B) and the movable iron piece 60 is disposed in the lower edge portion of the vertical portion 51 of the yoke 50. Further, the movable iron piece 60 is pivotably supported in such a manner that the engaging pawl 57 and the latching pawl 58 of the support spring 55 are engaged with and latched to the notch portions 52 of the yoke 50, respectively. Both-side edge portions of the yoke 50 are press-fitted in the press-fitting grooves 12 provided in the insulation wall 11 of the base 10.

On the other hand, the second fixed touch piece 72, the movable touch piece 73, and the first fixed touch piece 71 of the contact mechanism 70 are press-fitted within the other side in the upper surface of the base 10. Further, the other side in the upper surface is partitioned by the insulation wall 11. Subsequently, the contact protrusion 81 of the card 80 is brought into contact with the vicinity of an upper end portion of the movable iron piece 60, and the pair of elastic arm portions 82 and 82 are engaged with the pair of engaging notch portions 65 and 65 provided in the vertical portion 64 of the movable iron piece 60, respectively. The latching pawls 74 and 75 of the movable touch piece 73 are latched to the remaining end edge portion 83 of the card 80. Finally, the following process is performed and assembling work is completed. That is, the box-shaped cover 90 is fitted into the base 10, and sealing is performed by injecting a sealing material (not illustrated) in the bottom of the base 10. After that, inner gas is degassed through the degassing hole 92 of the box-shaped cover 90, and then the degassing hole 92 is subjected to heat caulking.

Figure 8A:
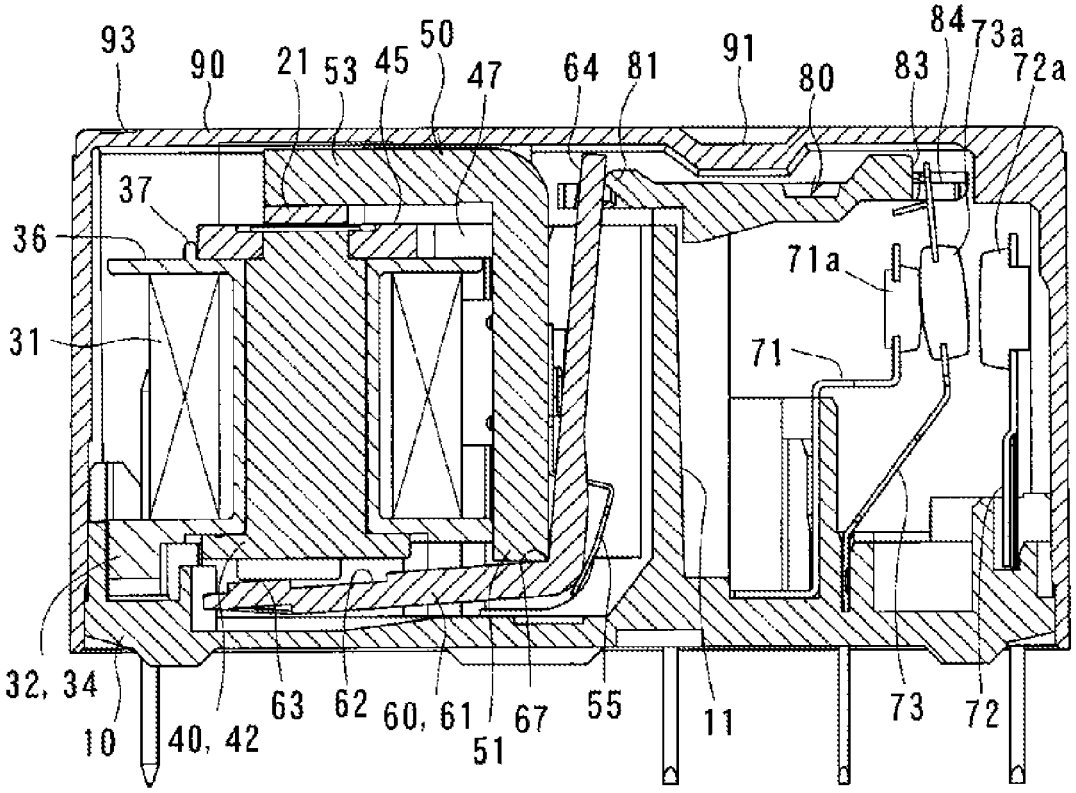
FIGS. 8A and 8B are cross-sectional views showing states before and after an operation of the electromagnetic relay illustrated in FIGS. 1A and 1B.
Figure 10A:
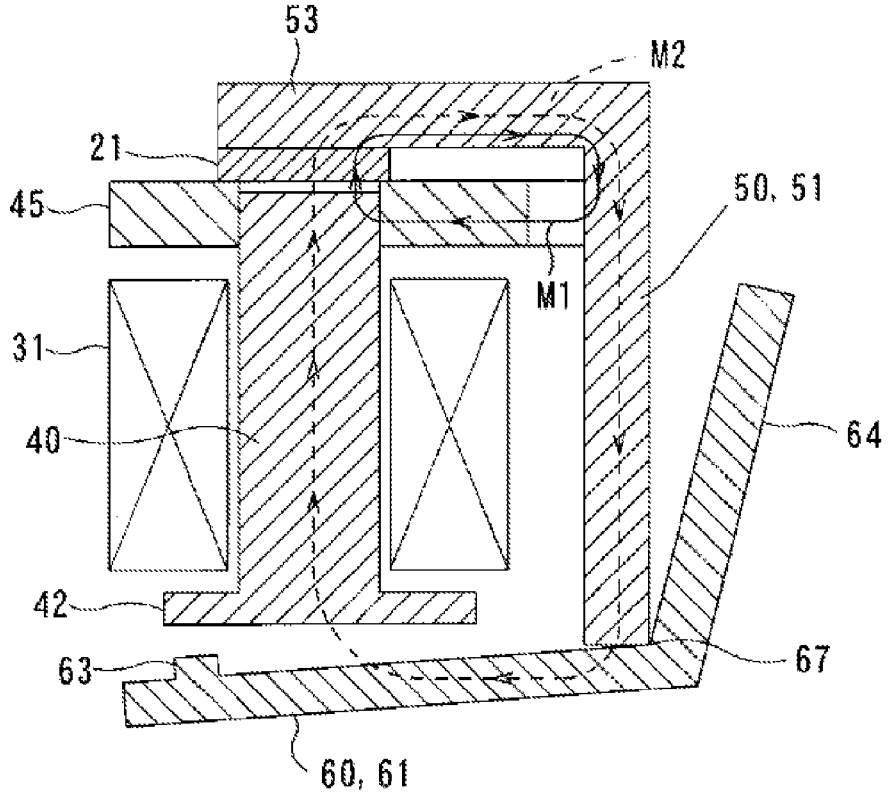
FIGS. 10A and 10B are schematic cross-sectional views describing an operation process of the electromagnet device.
Figure 10B:
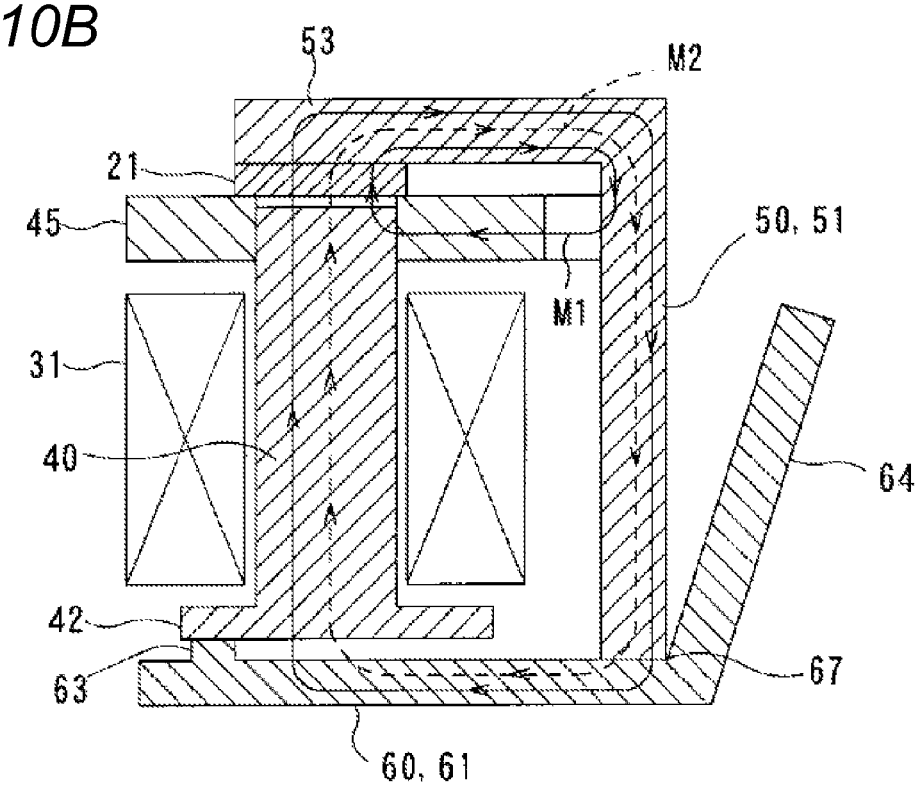

Next, an operation of the magnetic relay having the above-described structure will be described in accordance with one of the preferred embodiments of the invention. As illustrated in FIG. 8A, when a voltage is not applied to the coil 31, while the contact protrusion 63 of the movable iron piece 60 is separated from the magnetic pole portion 42 of the iron core 40, and the movable contact 73*a* is in contact with the first fixed contact 71*a*. During this state, as illustrated in FIG. 10A, the magnetic flux flowing out from the permanent magnet 21 flows through a magnetic circuit M1 which includes the auxiliary yoke 45, and leakage flux forms a magnetic circuit M2 via the yoke 50. For this reason, a state in which the movable iron piece 60 is separated from the magnetic pole portion 42 is maintained by balance between a spring force of the movable touch piece 73 and magnetism generated by the magnetic flux which flows to magnetic circuits M1 and M2. The magnetic circuit M1 is in a magnetically saturated state.

When the voltage is applied so that magnetic flux of the same direction as the magnetic flux of the permanent magnet 21 is generated in the coil 31, the magnetic flux generated by the voltage applied to the coil 31 flows to the magnetic circuit M2 (FIG. 10B), and an attraction force which attracts the movable iron piece 60 increases. For this reason, the movable iron piece 60 pivots on the pivoting shaft center 67, while resisting against the spring force of the movable touch piece 73. Thus the movable iron piece 60 is attracted to the magnetic pole portion 42 of the iron core 40, and the contact protrusion 63 is attracted to the magnetic pole portion 42.

Figure 8B:
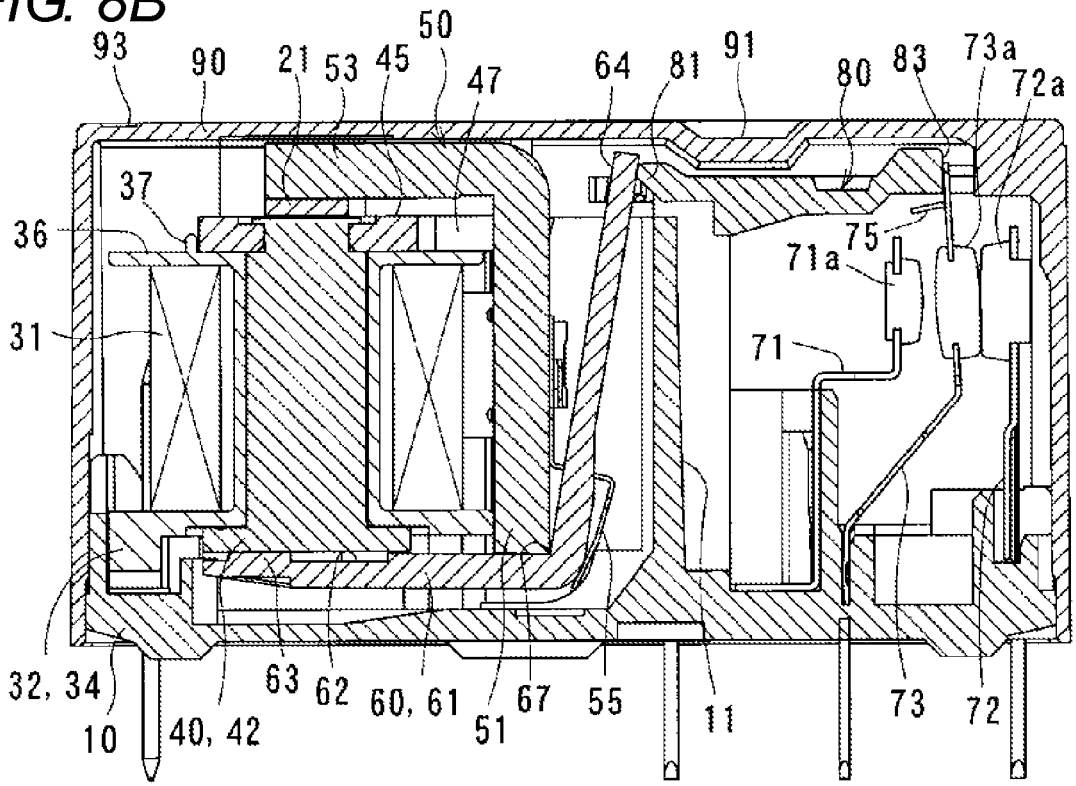
Figure 9:
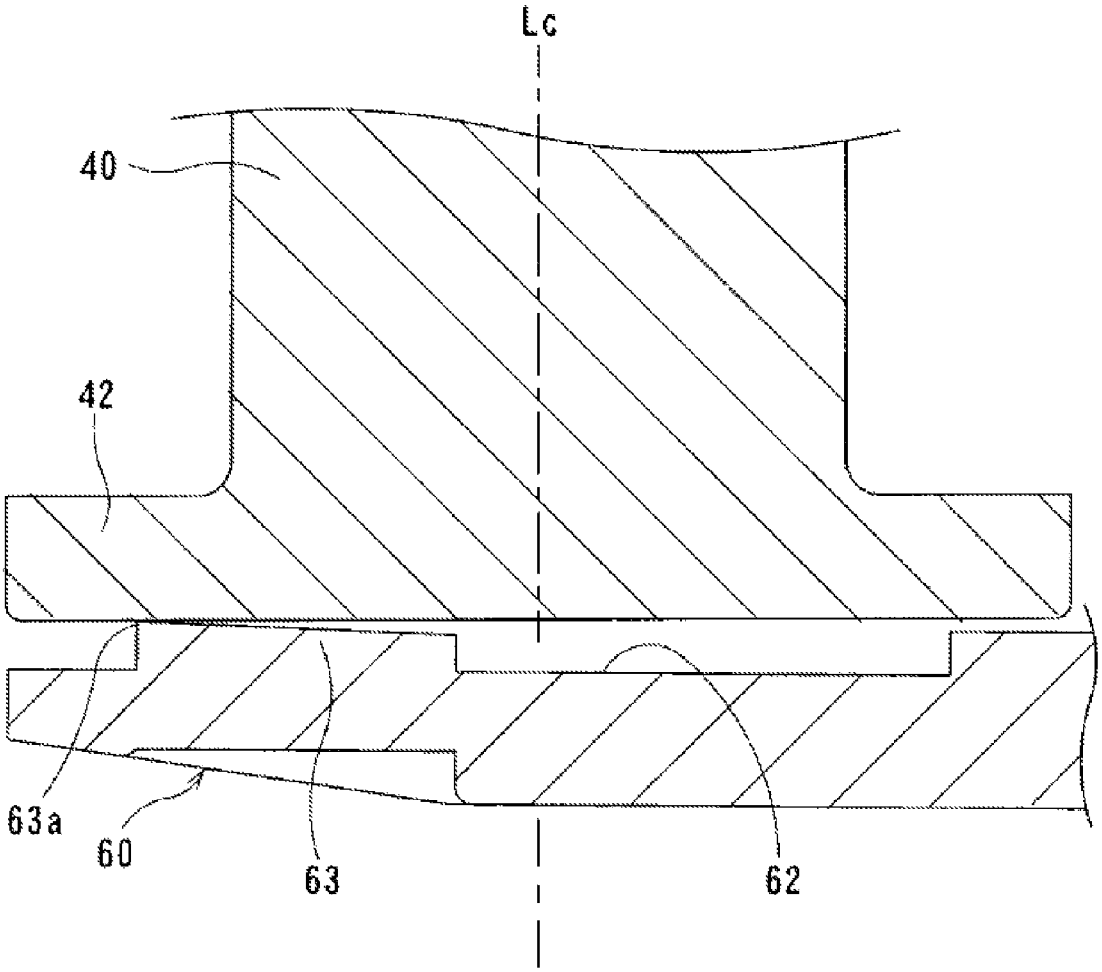
FIG. 9 is a partially enlarged cross-sectional view of a state in which the movable iron piece and the iron core are attracted to each other.

During this state, as illustrated in FIG. 9, the magnetic pole portion 42 and the contact protrusion 63 come into line contact with and attracted to each other via the outer edge portion 63*a* in a position opposite to the pivoting shaft center 67 (as shown in FIGS. 8A and 8B) with respect to a central axis Lc of the iron core 40. Therefore, it results into an increase in a distance between the contact portion where the magnetic pole portion 42 and the outer edge portion 63*a* are in contact with each other, and the pivoting shaft center 67. For this reason, in a state in which the movable iron piece 60 and the iron core 40 are attracted to each other thereby a magnetic moment for pivoting the yoke 50 increases, and thus the yoke 50 becomes difficult to return by pivoting on the pivoting shaft center 67. Therefore, an attraction force, i.e., a retention force between the movable iron piece 60 and the iron core 40 is certainly maintainable. Furthermore, since the magnetic pole portion 42 and the contact protrusion 63 are in contact with each other via the outer edge portion 63*a*, the magnetic flux concentrates and the retention force between the movable iron piece 60 and the iron core 40 increases. And since the distance between an attracted surface 66 of the horizontal portion 61 and the magnetic pole portion 42 is decreased and it becomes for the magnetic flux to easily flow, the attraction force increases. Thereby flexibility as well as degree of freedom in design increases.

When the contact protrusion 63 is attracted to the magnetic pole portion 42, the vertical portion 64 of the movable iron piece 60 presses the movable touch piece 73 via the card 80, and the movable contact 73*a* separates from the first fixed contact 71*a*, and comes into contact with the second fixed contact 72*a* (FIG. 8B).

Figure 11A:
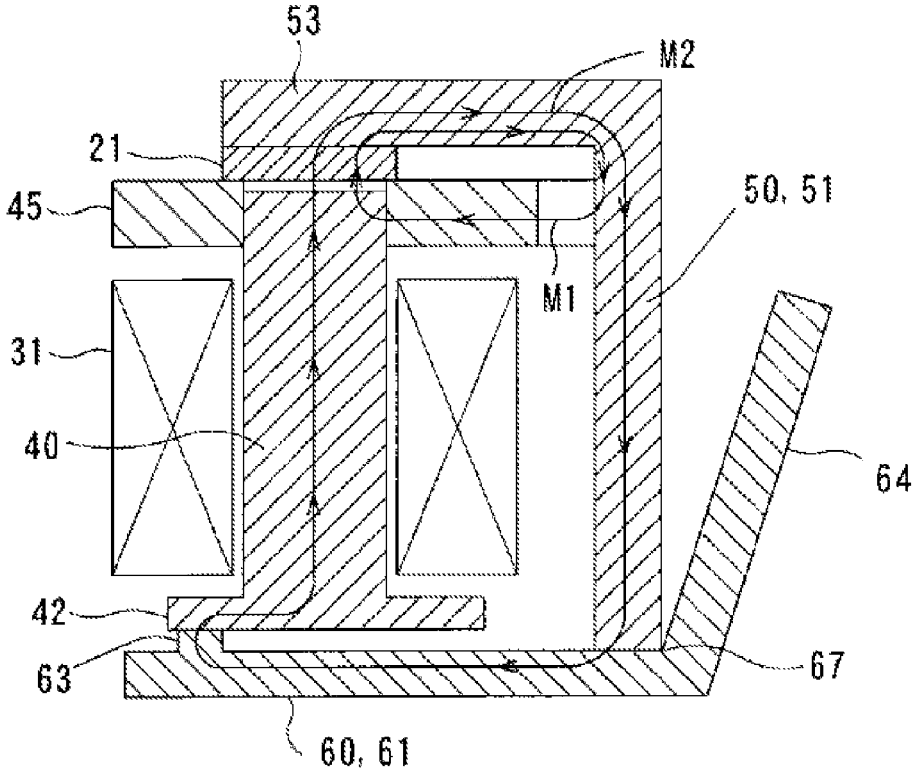
FIGS. 11A and 11B are schematic cross-sectional views describing an operation process of the electromagnet device which is subsequent to the operation process illustrated in FIGS. 10A and 10B.
Figure 11B:
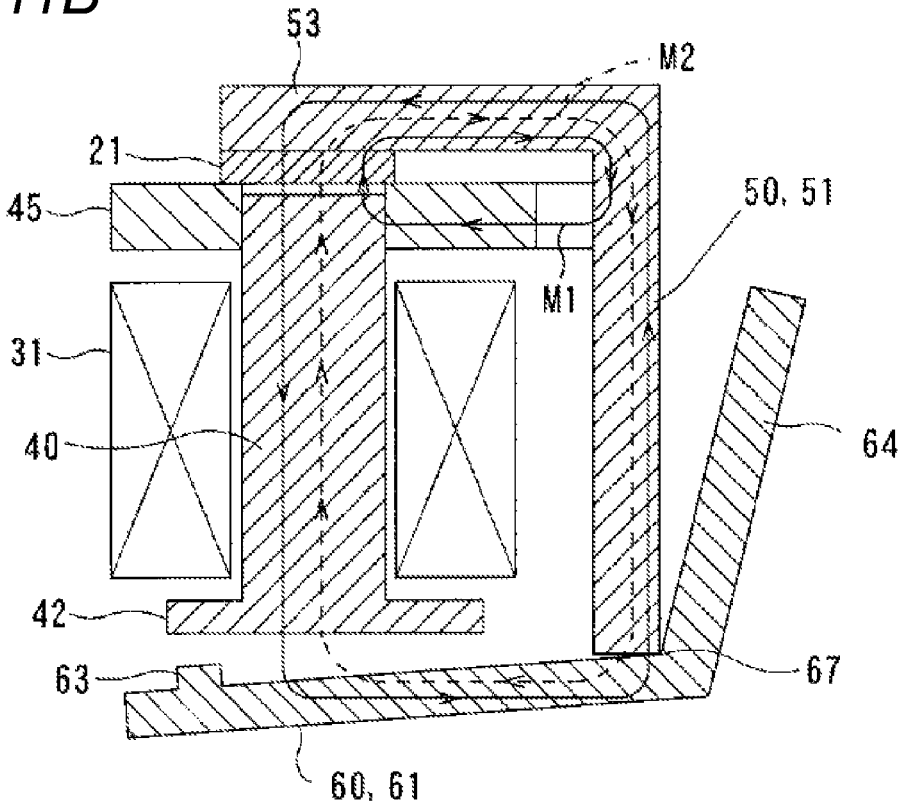

Subsequently, even through the application of the voltage to the coil 31 is stopped, as illustrated in FIG. 11A, a combined magnetic force of the magnetic flux which flows into the magnetic circuit M1 which includes the auxiliary yoke 45 from the permanent magnet 21, and the magnetic flux which flows into the magnetic circuit M2 which includes the yoke 50, the movable iron piece 60, and the iron core 40 is larger than the spring force of the movable touch piece 73. For this reason, the movable iron piece 60 maintains this current state, without pivoting.

When a return voltage of a reversed direction with respect to the previously described application voltage is applied to the coil 31 (refer to FIG. 11B) so that the magnetism of the permanent magnet 21 acting on the movable iron piece 60 will be canceled, the movable contact 73*a* separates from the second fixed contact 72*a*, comes into contact with first fixed contact 71*a*, and returns to the original state.

Even through the return voltage is applied in the present embodiment, since the magnetic circuit M1 which includes the auxiliary yoke 45 is in a magnetically saturated state, the magnetic flux does not flow through the magnetic circuit M1. For this reason, since all the magnetic flux of the coil which is generated by the applied return voltage flows into the magnetic circuit M2 and a return operation is carried out, wherein the magnetic circuit M2 includes the yoke, the movable iron piece, and the iron core. Thereby a latching type electromagnetic relay consuming less power is obtainable.

The present invention is not limited to the above-described embodiment, but various modifications thereof are possible. The surface of the contact protrusion 63 is made to be flat and smooth in the above-described embodiment. Alternatively, the surface may be an upward curving surface. With this configuration, a touch point of the movable iron piece 60 and the magnetic pole portion 42 the iron core 40 can be stabilized, allowing the magnetic flux to easily pass therethrough. Therefore, a fluctuation in magnetism can be prevented. The contact protrusion 63 is formed in a rectangular shape in the above-described embodiment. However, the shape is not particularly limited to the rectangular shape, as long as the contact protrusion 63 can come into line contact with the iron core 40.

Figure 12A:
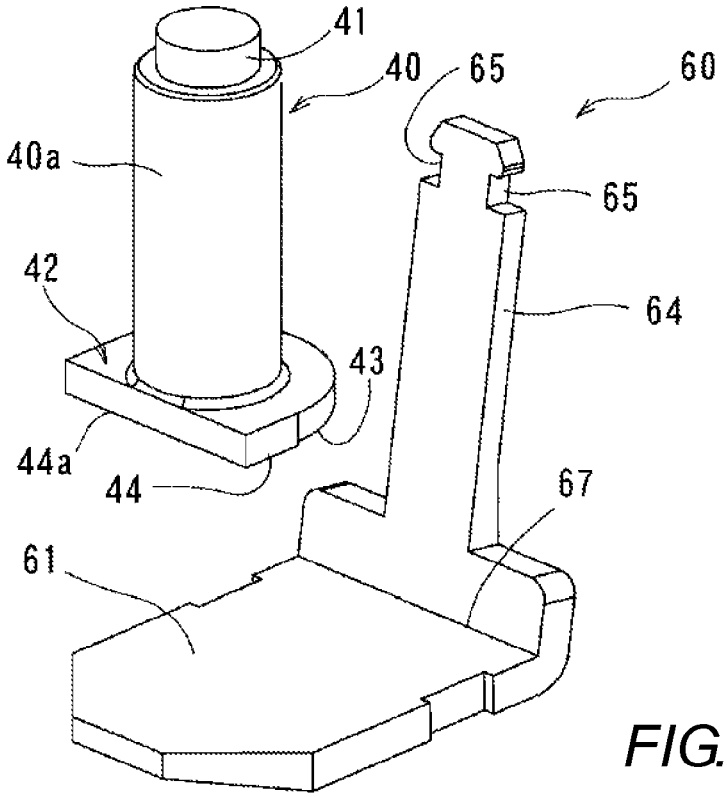
FIGS. 12A and 12B are perspective views of a modification of an iron core and a movable iron piece.
Figure 12B:
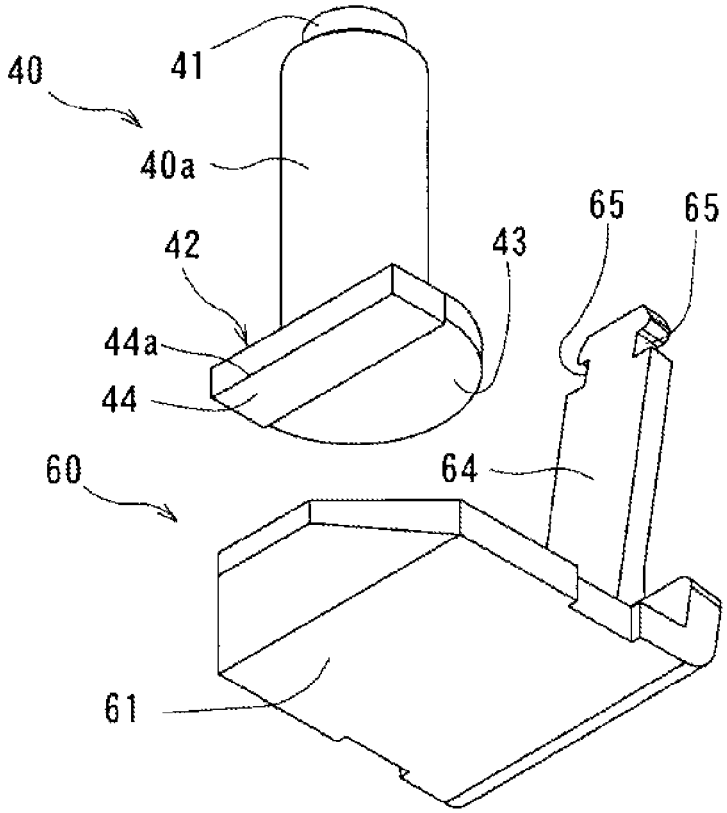

According to the above-described embodiment, the magnetic pole portion 42 of the iron core 40 is formed in a disc shape, and the contact protrusion 63 is provided in the movable iron piece 60. However, the shape of the magnetic pole portion 42 is not limited to the disc shape. For example, as illustrated in FIGS. 12A and 12B, a configuration may be adopted in which the magnetic pole portion 42 of the iron core 40 is provided with a semi-circular attracting surface 43 and a rectangular contact protrusion 44 formed in an edge of the attracting surface 43, especially in a position (on an outer side position) opposite to the pivoting shaft center 67 with respect to the central axis of the iron core 40. In this configuration, an outer edge portion 44*a* is formed in an outer portion of the contact protrusion 44. In this case, the upper surface of the horizontal portion 61 of the movable iron piece 60 is a flat and smooth surface without unevenness. By providing the attracting surface 43 in the iron core 40, when the iron core 40 and the movable iron piece 60 changes from a separated state to an attracted state, the magnetic flux comes to easily flow between the attracting surface 43 and the movable iron piece 60, and the attraction force increases. By providing the contact protrusion 44 in the outside of the central axis of the iron core 40, a distance between a contact surface of the outer edge portion 44*a* and the horizontal portion 61, and the pivoting shaft center 67 increases. For this reason, in a state in which the movable iron piece 60 and the iron core 40 are attracted to each other, thereby a magnetic moment for pivoting the yoke 50 increases, and thus the yoke 50 becomes difficult to return by pivoting on the pivoting shaft center 67. Therefore, an attraction force, i.e., a retention force between the movable iron piece 60 and the iron core 40 is certainly maintainable.

Figure 13A:
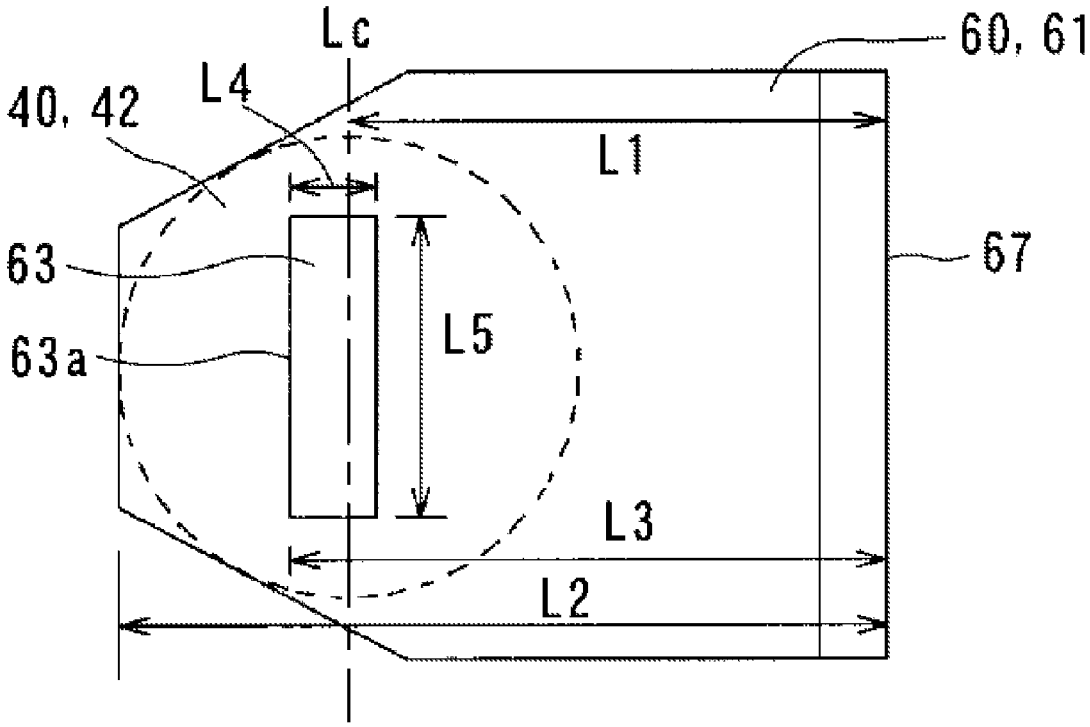
FIG. 13A is a schematic plan view of a horizontal portion and an iron core.

Further, the calculations are provided for changes in the attraction force (retention force) between the iron core 40 and the movable iron piece 60 with respect to positions of the contact protrusion 63 within the horizontal portion 61. Specifically, as illustrated in FIG. 13A, the pivoting shaft center 67 of the horizontal portion 61 is used as a fulcrum, a distance from the fulcrum to a central axis Lc of the magnetic pole portion 42 is defined as L1, a distance from the fulcrum to a leading end of the horizontal portion is defined as L2, and a distance from the fulcrum to the outer edge portion 63*a* of the contact protrusion 63 is defined as L3. A length dimension of the contact protrusion 63 is defined as L4, a width dimension is defined as L5, and L4 and L5 are set to fixed values like L4=1 mm and L5=2.44 mm. When the outer edge portion 63*a* of the contact protrusion 63 is located on the central axis Lc of the magnetic pole portion 42 (i.e., when L3=L1), the position in this case is set to 0%. And when the outer edge portion 63*a* of the contact protrusion 63 is located in a leading end of the horizontal portion 61, i.e. when L3=L2, the position in this case is set to 100%. The calculation result is illustrated in FIG. 13B.

Figure 13C:
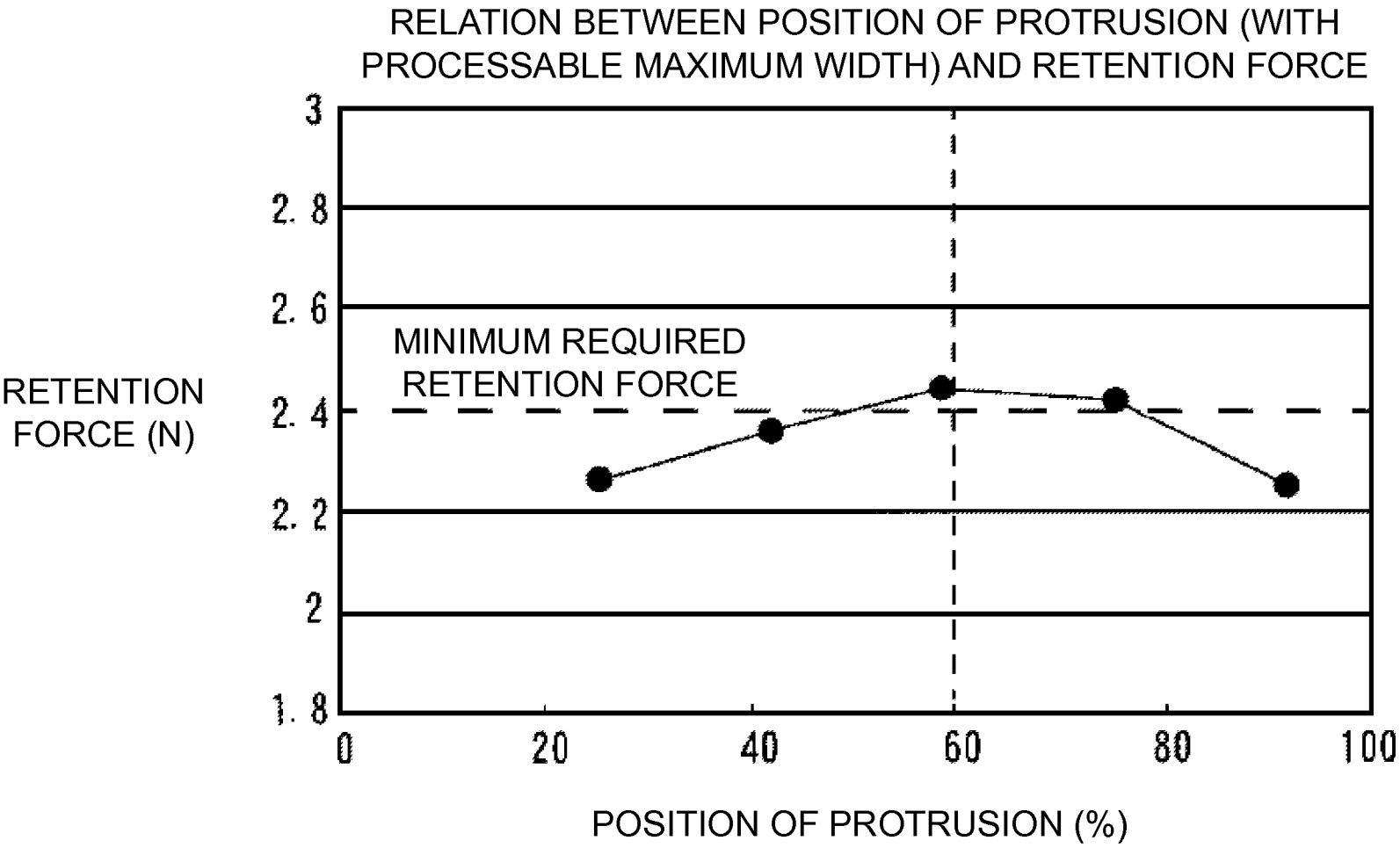
FIG. 13C is a graph indicating a change of the result illustrated in FIG. 13B.

As illustrated in FIG. 13B, when L3=8.75 mm, i.e., when the position is set to 58%, the retention force becomes the maximum. It is found that the retention force gradually decreases in both cases where the value of L3 increases and decreases than this value. As illustrated in FIG. 13C, in order to obtain a retention force larger than 2.4 N which is the minimum requisite retention force between the iron core 40 and the movable iron piece 60, it is found that the outer edge portion 63*a* needs to be located between a position corresponding to 50% and a position corresponding to 75%.

As described above, in order that the contact protrusion 63 and the iron core 40 are attracted to each other and maintained as attracted in a position opposite to the pivoting shaft center 67 with respect to the central axis Lc of the iron core 40, it is found that preferably the outer edge portion 63*a* of the contact protrusion 63 is located between a position corresponding to 50% and a position corresponding to 75%, and the maximum retention force is obtained particularly when the position is set to 58%.

Figure 14A:
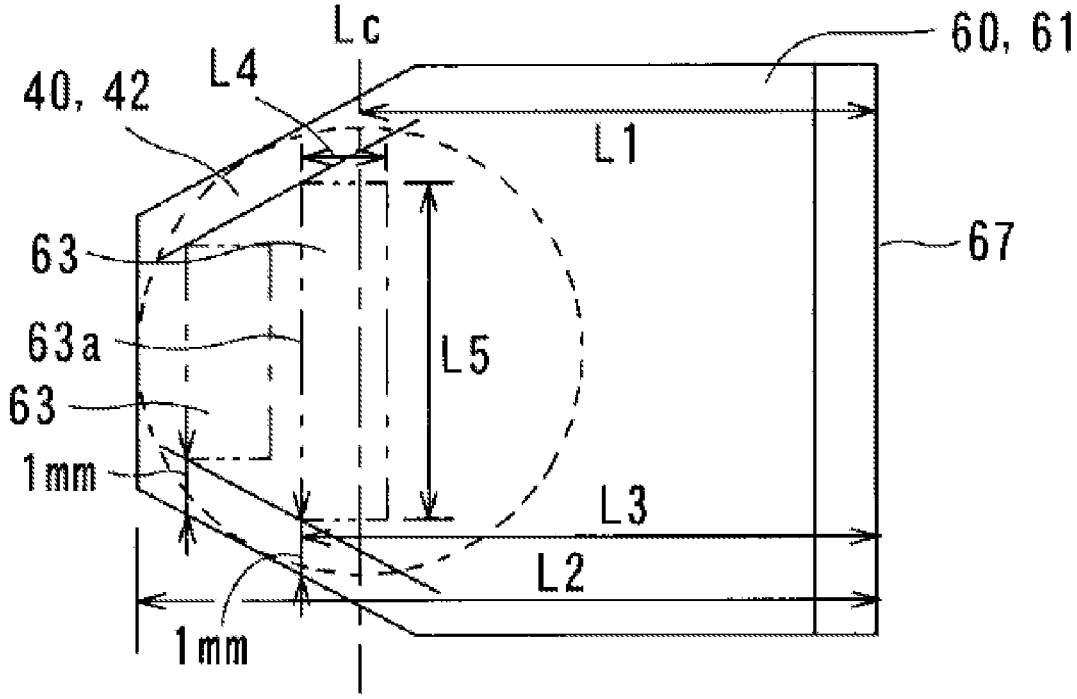
FIG. 14A is a schematic plan view of an iron core and a horizontal portion in which a contact protrusion is formed at an interval which is required for processing from an outer form.

Further, calculations are provided for changes in the attraction force (retention force) between the iron core 40 and the movable iron piece 60 with respect to positions of the contact protrusion 63 within the horizontal portion 61 and a change in the width dimension L5. Specifically, as illustrated in FIG. 14A, the pivoting shaft center 67 of the horizontal portion 61 is used as a fulcrum, a distance from the fulcrum to the central axis Lc of the magnetic pole portion 42 is defined as L1, a distance from the fulcrum to the leading end of the horizontal portion is defined as L2, and a distance from the fulcrum to the outer edge portion 63*a* of the contact protrusion 63 is defined as L3. When the outer edge portion 63*a* of the contact protrusion 63 is located on the central axis Lc of the magnetic pole portion 42 (i.e., when L3=L1), the position in this case is set to 0%. And when the outer edge portion 63*a* of the contact protrusion 63 is located at a leading end of the horizontal portion 61, i.e. when L3=L2, the position in this case is set to 100%.

The length dimension of the contact protrusion 63 is defined as L4, and L4 is a fixed value (i.e. L4=1 mm). In order to provide the contact protrusion 63 in the horizontal portion 61, the contact protrusion 63 needs to be provided inside so as to have a distance by 1 mm or more from an outer diameter of the horizontal portion 61 in the processing. For this reason, when the width dimension of the contact protrusion 63 is defined as L5, the value of L5 changes as follows. When the outer edge portion 63*a* is located on the central axis Lc, the value of L5 becomes the maximum, and when the outer edge portion 63*a* is located in the leading end of the horizontal portion 61, the value of L5 becomes the minimum. The calculation result under these conditions is indicated in FIG. 14B.

Figure 14C:
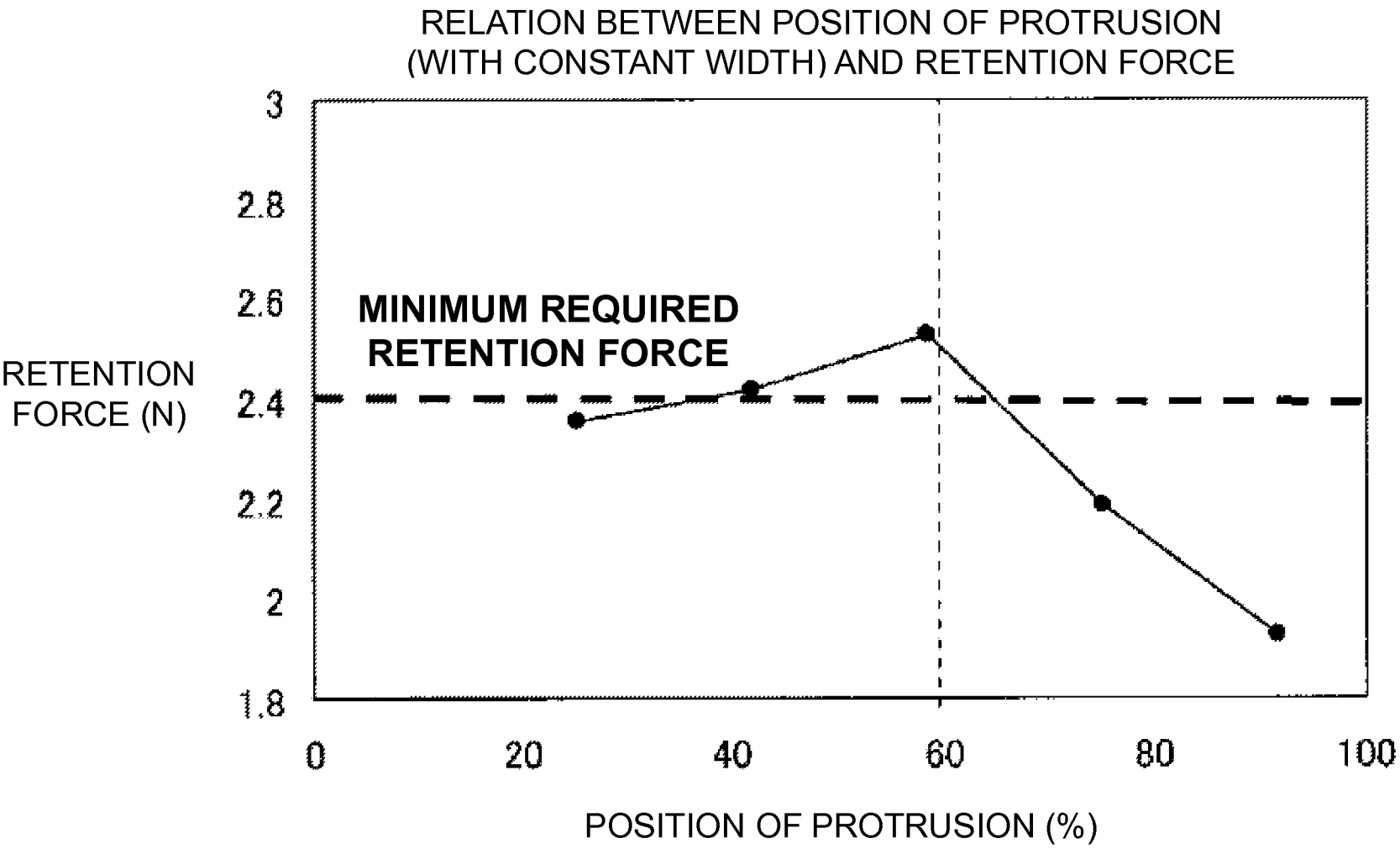
FIG. 14C is a graph showing a change of the result illustrated in FIG. 14B.

As illustrated in FIG. 14B, when L3=8.75 mm, i.e., when the outer edge portion 63*a* is located in a position corresponding to 58%, it is found that the retention force becomes the maximum. It is also found that the retention force gradually decreases in both cases where the value of L3 increases and decreases than this value. As illustrated in FIG. 14C, in order to obtain a retention force larger than 2.4 N which is the minimum requisite retention force between the iron core 40 and the movable iron piece 60, it is found that the outer edge portion 63*a* needs to be located between a position corresponding to 40% and a position corresponding to 65%.

As described above, in order that the contact protrusion 63 and the iron core 40 are attracted to each other and maintained as attracted in a position opposite to the pivoting shaft center 67 with respect to the central axis Lc of the iron core 40, it is found that preferably the outer edge portion 63*a* of the contact protrusion 63 is located between a position corresponding to 40% and a position corresponding to 65%, and the maximum retention force is obtained particularly when the position is set to 58%.

It is needless to say that the electromagnet device according to the present invention is applied not only to an electromagnetic relay but also to other electronic equipment.

There has thus been shown and described an electromagnetic device and electromagnetic relay using the same which fulfills all the advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electromagnet device comprising:

an electromagnet block comprising a spool around which a coil is wound and an iron core inserted in a central hole of the spool;

a yoke connected to an end portion of the iron core via a permanent magnet;

a movable iron piece having a pivoting shaft center, the movable iron piece being pivotally disposed at an end face edge portion of the yoke with the pivoting shaft center supported by and disposed in pivotal contact with the end face edge portion of the yoke, the movable iron piece being adapted to pivot on a basis of magnetization and demagnetization of the electromagnet block, and a protrusion comprising a linear edge portion which extends in parallel to the pivoting shaft center and the protrusion protrudes from at least either the movable iron piece or the iron core, the protrusion protrudes in a facing direction in which the movable iron piece and the iron core face each other, wherein the movable iron piece is adapted to be in line contact with the iron core via an outer edge portion of the protrusion on magnetization of the electromagnet block, the outer edge portion is located in an outside position as compared with a central axis of the iron core when the electromagnet block is magnetized;

wherein the protrusion is provided in the movable iron piece and the outer edge portion is adapted to be in contact with a magnetic pole surface of the iron core; and wherein the outer edge portion is located in a position opposite to the pivoting shaft center with respect to the central axis of the iron core, and the protrusion has a rectangular shape.

2. The electromagnet device according to claim 1, wherein the protrusion is provided in the iron core, and the outer edge portion is adapted to be in contact with a horizontal portion of the movable iron piece.

3. An electromagnetic relay comprising the electromagnet device according to claim 2.

4. An electromagnetic relay comprising the electromagnet device according to claim 1.

* * * * *